US007241377B2

(12) United States Patent
Malone

(10) Patent No.: US 7,241,377 B2
(45) Date of Patent: Jul. 10, 2007

(54) SALT BATH REFINING

(75) Inventor: Donald P. Malone, Grayson, KY (US)

(73) Assignee: DTX Technologies, LLC, Lexington, KY (US)

( * ) Notice: Subject to any disclaimer, the term of this patent is extended or adjusted under 35 U.S.C. 154(b) by 0 days.

(21) Appl. No.: 10/918,956

(22) Filed: Aug. 16, 2004

(65) Prior Publication Data

US 2007/0084755 A1 Apr. 19, 2007

Related U.S. Application Data

(60) Provisional application No. 60/500,119, filed on Sep. 4, 2003.

(51) Int. Cl.
*C10M 175/00* (2006.01)
*C10G 7/00* (2006.01)

(52) U.S. Cl. ..... 208/179; 208/177; 208/347

(58) Field of Classification Search ..... 208/177, 208/179, 347
See application file for complete search history.

(56) References Cited

U.S. PATENT DOCUMENTS

| | | | | |
|---|---|---|---|---|
| 1,527,847 | A * | 2/1925 | Duckham et al. | 196/118 |
| 1,573,370 | A * | 2/1926 | Blumner | 208/360 |
| 1,635,896 | A * | 7/1927 | Morgan et al. | 208/42 |
| 1,672,459 | A * | 6/1928 | Jansen | 208/72 |
| 2,276,307 | A | 3/1942 | Houdry | |
| 3,173,859 | A * | 3/1965 | Chambers | 208/184 |
| 3,210,268 | A * | 10/1965 | Hendal et al. | 585/634 |
| 4,012,457 | A | 3/1977 | Bredeson et al. | |
| 4,421,631 | A * | 12/1983 | Ampaya et al. | 208/404 |
| 5,244,565 | A | 9/1993 | Lankton et al. | |
| 5,286,380 | A | 2/1994 | Mellen | |
| 5,302,282 | A | 4/1994 | Kalnes et al. | |
| 5,556,548 | A | 9/1996 | Mellen | |
| 5,619,806 | A | 4/1997 | Warren | |
| 6,068,759 | A | 5/2000 | Moore et al. | |
| 6,110,239 | A | 8/2000 | Malone et al. | |
| 6,372,122 | B1 | 4/2002 | Gorman | |
| 6,447,672 | B1 | 9/2002 | Moore et al. | |
| RE38,366 | E | 12/2003 | Kenton | |

FOREIGN PATENT DOCUMENTS

| | | | |
|---|---|---|---|
| EP | 70789 A2 | * | 1/1983 |
| GB | 1357495 A | * | 5/1974 |
| JP | 59124991 A | * | 7/1984 |

OTHER PUBLICATIONS

English translation of JP 59-124991, Jul. 19, 1984.*

* cited by examiner

*Primary Examiner*—Glenn Caldarola
*Assistant Examiner*—John Douglas
(74) *Attorney, Agent, or Firm*—Richard D. Stone

(57) ABSTRACT

A process for heating thermally unstable or difficult to heat liquid feeds, e.g., used lubricating oil (ULO) to dehydrate and/or recover distillable components therefrom, is disclosed. The liquid feed is heated by direct contact heat exchange with molten salt, preferably maintained as a bath, operating at a temperature above the boiling point of water and below 600 C. The liquid feed is heated and typically at least partially vaporized in, or above, or by contact with the molten salt to produce a heated liquid. When ULO contaminated with water is the feed, the vapor product of the process will comprise water vapor and/or distillable hydrocarbons. ULO additive decomposition products, such as carbon, may be removed as a solid, semi-solid or liquid residual phase from contact with the molten salt.

15 Claims, 3 Drawing Sheets

SALT BATH REFINING

CROSS REFERENCE TO RELATED APPLICATIONS

This application claims the benefit, and is a copy, of my prior provisional application No. 60/500,119, filed Sep. 4, 2003 and incorporated by reference.

FIELD OF THE INVENTION

The invention relates to direct contact heating of normally liquid hydrocarbons and the like, especially those which are thermally unstable or difficult to heat, e.g., processing used motor oil to recover distillable and non-distillable hydrocarbons.

BACKGROUND OF THE INVENTION

Automotive and many industrial lubricating oils are usually formulated from paraffin based petroleum distillate oils or from synthetic base lubricating oils. Lubricating oils are combined with additives such as soaps, extreme pressure (E.P.) agents, viscosity index (V.I.) improvers, antifoamants, rust inhibitors, antiwear agents, antioxidants, and polymeric dispersants to produce an engine lubricating oil of SAE 5 to SAE 60 viscosity.

After use, this oil is collected from truck and bus fleets, automobile service facilities, municipal motor oil recycling centers and retail stores. There is also a significant volume of oil collected from the industrial sector, e.g., cutting, stamping and coolant oils, which is collected on a direct basis or is collected from oily-water dehydrating facilities. This collected oil contains organo-metallic additives such as zinc dialkylthiophosphate from the original lubricating oil formulation, sludge formed in the engine, and water. The used oil may also contain contaminants such as waste grease, brake fluid, transmission oil, transformer oil, railroad lubricant, crude oil, antifreeze, dry cleaning fluid, degreasing solvents such as trichloroethylene, edible fats and oils, mineral acids, soot, earth and waste of unknown origin.

Reclaiming of waste oil is largely carried out by small processors using various processes tailored to the available waste oil, product demands, and local environmental considerations. Such processes at a minimum include partial de-watering and coarse filtering. Some more sophisticated processors may practice chemical demetallizing or distillation. The presence of organo-metallics in waste oils such as zinc dialkylthiophosphate results in decomposition of the zinc dialkyldithiophospnate to form a carbonaceous layer rich in zinc and often other metals such as calcium, magnesium and other metals present as additives and thus difficult if not impossible to process. The carbonaceous layer containing the various metals forms rapidly on heated surfaces and can develop to a thickness of more than 1 mm in 24 hours. This layer not only reduces the heat transfer coefficient of tubular heaters rapidly, it also results in substantial or total occlusion of these tubes within a few days.

Successful reclaiming processes require the reduction of the organo-metallics (or ash) content to a level at which the hot oil does not foul heated surfaces. Such reduction can be carried out by chemical processes which include reacting cation phosphate or cation sulfate with the chemically bonded metal to form metallic phosphate or metallic sulfate. U.S. Pat. No. 4,432,865 to Norman, the contents of which are incorporated herein by reference, discloses contacting used motor oil with polyfunctional mineral acid and polyhydroxy compound to react with undesired contaminants to form easily removable reaction products. These chemical processes suffer from attendant disposal problems depending on the metal by-products formed.

Ash content can also be reduced by heating the used lubricating oil to decompose the organo-metallic additives. However, indirect heat exchange surfaces cannot be maintained above 400.degree. F. (204.degree. C.) for extended periods without extensive fouling and deposition of metals from the additives. Used lubricating oils can be heated to an additive decomposition temperature of 400.degree. F. (204.degree. C.) to 1000.degree. F. (538.degree. C.) by direct heat exchange by mixing with a heated product oil as disclosed in U.S. Pat. No. 5,447,628 to Harrison, et al., the contents of which are incorporated herein by reference. However, dilution of the product oil with used oil requires reprocessing already processed product oil . . .

UOP's Hy-Lube process, described in U.S. Pat. Nos. 5,244,565 and 5,302,282, and many more, uses a hot circulating hydrogen stream as a heating medium to avoid deposition of decomposed organo-metallic compounds on heating surfaces.

The problem of fouling of heated surfaces can be ameliorated to some extent by gentler heating. Some processes, such as the fixed bed version of catalytic cracking, the Houdry process, used a molten salt bath to provide controlled, somewhat gentle heating of vaporized liquid hydrocarbon passing through tubes of catalyst immersed in the salt bath. Molten metal baths have also been used as a convenient way to heat difficult to processes substances to a control temperature, e.g., flammability of some plastics is tested by putting a flask with plastic into a bath of molten metal. Use of molten salt bath, or molten metal bath, or condensing high temperature vapor, could be used to reduce uneven heating of heat exchange surface and thereby reduce dT across a metal surface and perhaps slow the fouling of metal surfaces in ULO service, but the additives in the ULO would still tend to decompose on the hottest surface, which would be the heat exchanger tubes.

Although not related to ULO heating, in addition to the use of molten metal or molten salt for indirect heating as discussed above, there has been use, either commercial, or reported in the patent literature, of use of molten metal for direct contact heating of various substances. The float process for making glass is almost 50 years old. Molten metal, primarily lead, for heating coal or shale has been practiced in one form or another for almost 100 years. There are recent reports and patents on use of molten metal baths for waste pyrolysis, and conversion of latex, by heating ground up plants in a metal bath to make an oily overhead product. Also somewhat related, but even more different than anything discussed above, is the HyMelt® process, using molten iron beds for dissolution of various feed stocks. Temperatures in the HyMelt process are so high that if a liquid hydrocarbon feed is fed to a HyMelt reactor, the feed almost instantaneously dissociates in hydrogen and carbon, with the carbon dissolving in the molten iron. This is an excellent process for dissociating a hydrocarbon into its elemental constituents, but may be overkill for, e.g., reprocessing ULO, when all that is needed is enough heating to vaporize the lube boiling range components.

Extensive work has also been done on use of molten salt baths to oxidize unwanted and difficult to process streams. Usually the salt baths are heat sources and reagents, i.e., intended to react with the feed, as reported in U.S. Pat. No. 3,845,910 or 4,602,574, which are incorporated by reference.

Some researchers took the position that fouling of metal surfaces during ULO processing was going to happen, and that the best way to deal with it was to inject something into the ULO which would scrub the metal clean, i.e., injecting an abrasive material.

Solvent extraction with light paraffin solvents such as propane, butane, pentane and mixtures thereof have been practiced by Interline and others. Details of the Interline Process are provided in U.S. Pat. No. 5,286,380 and U.S. Pat. No. 5,556,548. While the extraction approach seems like an elegant solution to the problem of processing ULO, the process may be relatively expensive to operate. Their quarterly report of May 15, 2002, reports that "It has become evident that demanding royalties based on production is impractical in many situations and countries. Unless and until the re-refined oil produced in a plant can be sold at prices comparable to base lubricating oils, collecting royalties based on production will be difficult. This reality was experienced in Korea, where the royalty was terminated for the first plant, and in England where the royalties were reduced and deferred until the plant becomes profitable.

A breakthrough in ULO processing occurred with direct contact heating of the ULO with steam or a non-hydrogenating gas. This approach solved the problem of zinc additive decomposition fouling of hot metal surfaces, by ensuring that the metal surfaces holding the ULO were always relatively cool. The hottest spot in these ULO process was the point of vapor injection. Decomposing additives had only themselves to condense upon. Such a vapor injection ULO process was disclosed in my earlier patent, U.S. Pat. No. 6,068,759, Process for Recovering Lube Oil Base Stocks from Used Motor Oil . . . and in U.S. Pat. No. 6,447,672, Continuous Plural State Heated Vapor Injection Process for Recovering Lube Oil Base Stocks from Used Motor Oil . . . Other variations on the theme of ULO vapor injection processes are disclosed in U.S. Pat. No. 6,402,937 Pumped Recycle Vapor and U.S. Pat. No. 6,402,938, Vaporization of Used Motor Oil with Non-hydrogenating Recycle Vapor, which are incorporated by reference.

The "state of the art" of used motor oil processing could be summarized as follows:

Chemical additive and extraction approaches can be used to react with, or extract everything but, zinc additives, but costs associated with such processes are apparently high, as evidenced by little commercial use. Additives could be extracted, but the operating costs are high.

Indirect heating, in a fired heater, causes rapid fouling of metal surfaces. Using milder heating, via a double boiler approach or molten metal heating medium, can minimize but not eliminate fouling on hot metal surfaces.

Direct contact heating with high pressure hydrogen may eliminate fouling but requires high capital and operating expenses.

Direct contact heating, with recycled product oil, helps but requires processing the ULO twice.

Oxidation, either by burning as a low grade fuel, or perhaps as part of a salt bath oxidation process for waste streams.

Direct contact heating with steam or non-hydrogenating vapor, as reported in my U.S. Pat. No. 6,068,759 and the related patents discussed above, is believed to be the best available technology. This approach requires only moderate capital investment and moderate operating expense when steam is the injected vapor, but the process can create a water disposal problem and is thermally less efficient because the latent heat of water is lost when the steam is condensed against cooling water or air in a heat exchanger. When other vapors are injected for heating e.g., propane, the water problem goes away but large volumes of vapor are needed to provide sufficient heat input, so costs increase to heat and recycle such vapor streams.

Although my earlier work, steam injection for direct contact heat exchange, solved the worst problem, fouling on hot metal surfaces, it had some deficiencies as briefly noted above. I wanted an even better approach.

I thought about steam injection. The steam injection process seemed nice and simple, because it was easy to heat water to make steam. Unfortunately, using large amounts of water created a potential water disposal problem and produced a relatively "wet" plant, with many potential areas for corrosion as the steam condensed. Re-using the condensed water was possible, but there are concerns about the amount of water treatment required to remove chlorides, etc, so that corrosion and/or plugging of the tubes in the fired heater would not be a problem. Large volumes of steam were required, which resulted in relatively large plant volumes, at least until some or all of the injected steam was condensed. I realized that although the use of steam was a great advance in the art, it might not be the best approach.

The "pumped vapor" approach, use of propane or other recycle hydrocarbon vapor eliminates many concerns about water, but required a more complicated plant to recycle the hydrocarbon vapor. Large molar volumes of injected vapor are needed because of the relatively low heat capacity of hydrocarbon vapors. Condensation and separation of multiple hydrocarbon species, both injected heating vapors and recovered lubricating components, is more complicated than cooling everything and allowing water and oil to separate as separate phases.

I wanted to retain the beneficial features of heating the ULO by injecting something hot into it, but avoid the problems created by using either steam or a light hydrocarbon vapor as the heating medium. I found a way to overcome these deficiencies, by using a non-pyrolizing molten salt bath as the heating fluid.

There are many salts available which are fluid at relatively low temperatures which have ideal properties for use herein. They are relatively non-corrosive, especially when used in a reducing atmosphere. They are inexpensive and easy to contain. Molten salt is sufficiently dense to hold a lot of heat, permitting reasonably efficient heating of waste streams. They are not volatile, so they do not contribute to air or water pollution. They are immiscible with ULO so the decomposition products and trash found in the ULO can be easily removed from the molten salt bath. Molten salt also permits a flexible design approach, permitting injection of the molten salt into the oil or vice versa, though not necessarily with equivalent results. When oil is injected into a molten salt bath, it is easy to increase or decrease process severity by changing the depth of molten salt in the bath or the temperature of the salt or the pressure in the molten salt bath.

BRIEF SUMMARY OF THE INVENTION

Accordingly, the present invention provides a process for heating a liquid feed stream comprising a normally liquid hydrocarbon comprising direct contact heating of said liquid feed by contact with molten salt to produce heated liquid.

In another embodiment, the present invention provides a method of refining used lubricating oil (ULO) containing lubricant boiling range hydrocarbons and thermally decomposable additives to recover as a hydrocarbon liquid product at least a portion of said lubricant boiling range hydrocarbons comprising heating said ULO by direct contact heat exchange with molten salt having a temperature of 100 to 500 C for a time sufficient to vaporize at least a portion of said lubricant boiling range hydrocarbons and removing as a vapor product said lubricant boiling range hydrocarbons.

In yet another embodiment, the present invention provides, in a process for heating a thermally unstable liquid feedstock which cokes and/or rapidly fouls salt surfaces such as tubes in a fired heater, heat exchanger tubes, or the like, the improvement comprising heating said thermally unstable liquid feedstock by direct contact heat exchange with molten salt to produce a heated feed as a product of the process.

The invention will be more fully understood from the following description of the preferred embodiment taken in conjunction with the figures.

DETAILED DESCRIPTION OF PREFERRED EMBODIMENTS

Figure 1:
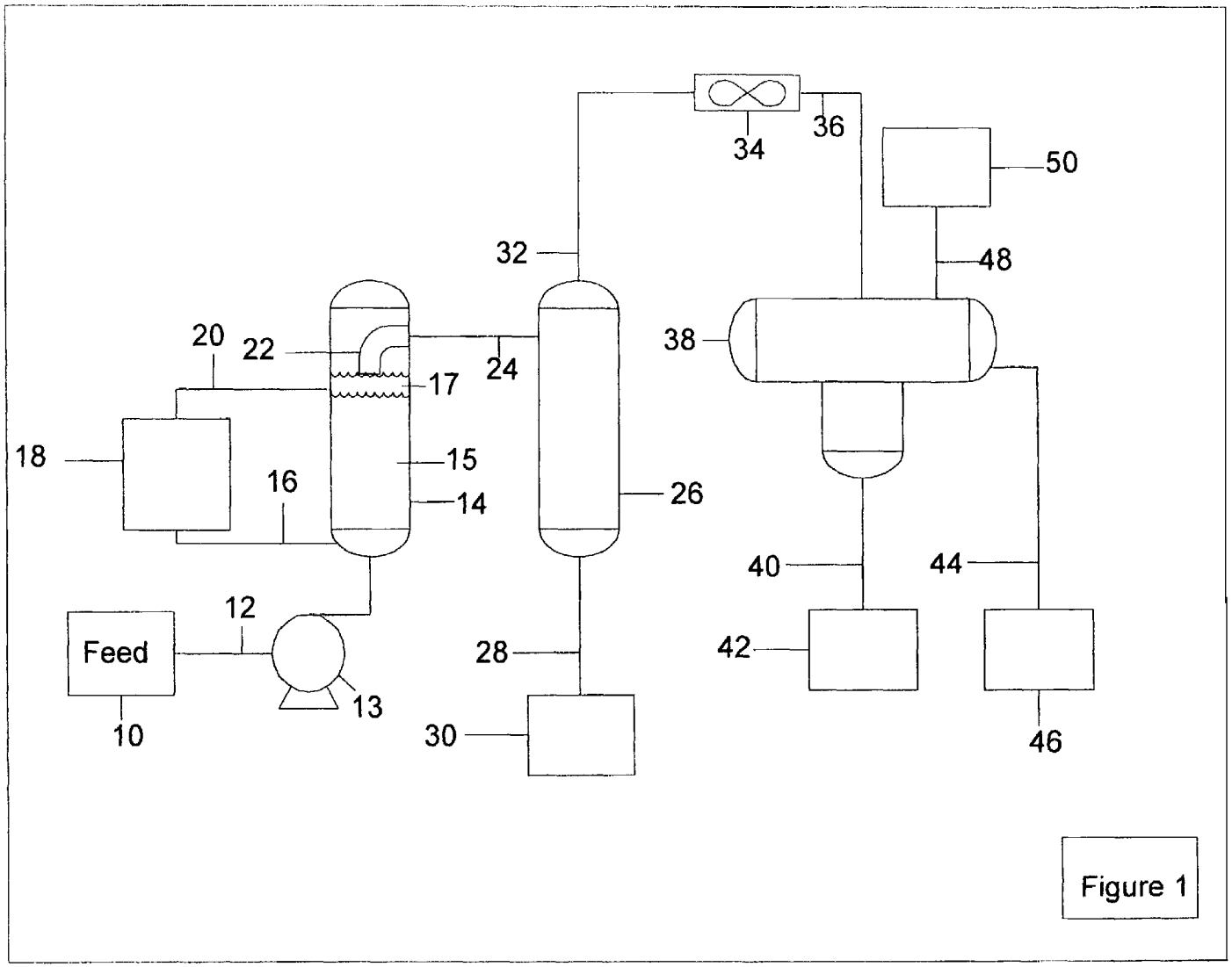
FIG. 1 is a simplified schematic drawing of a preferred embodiment wherein used oil is refined by direct contact heating with a continuous phase of molten salt.
Figure 2:
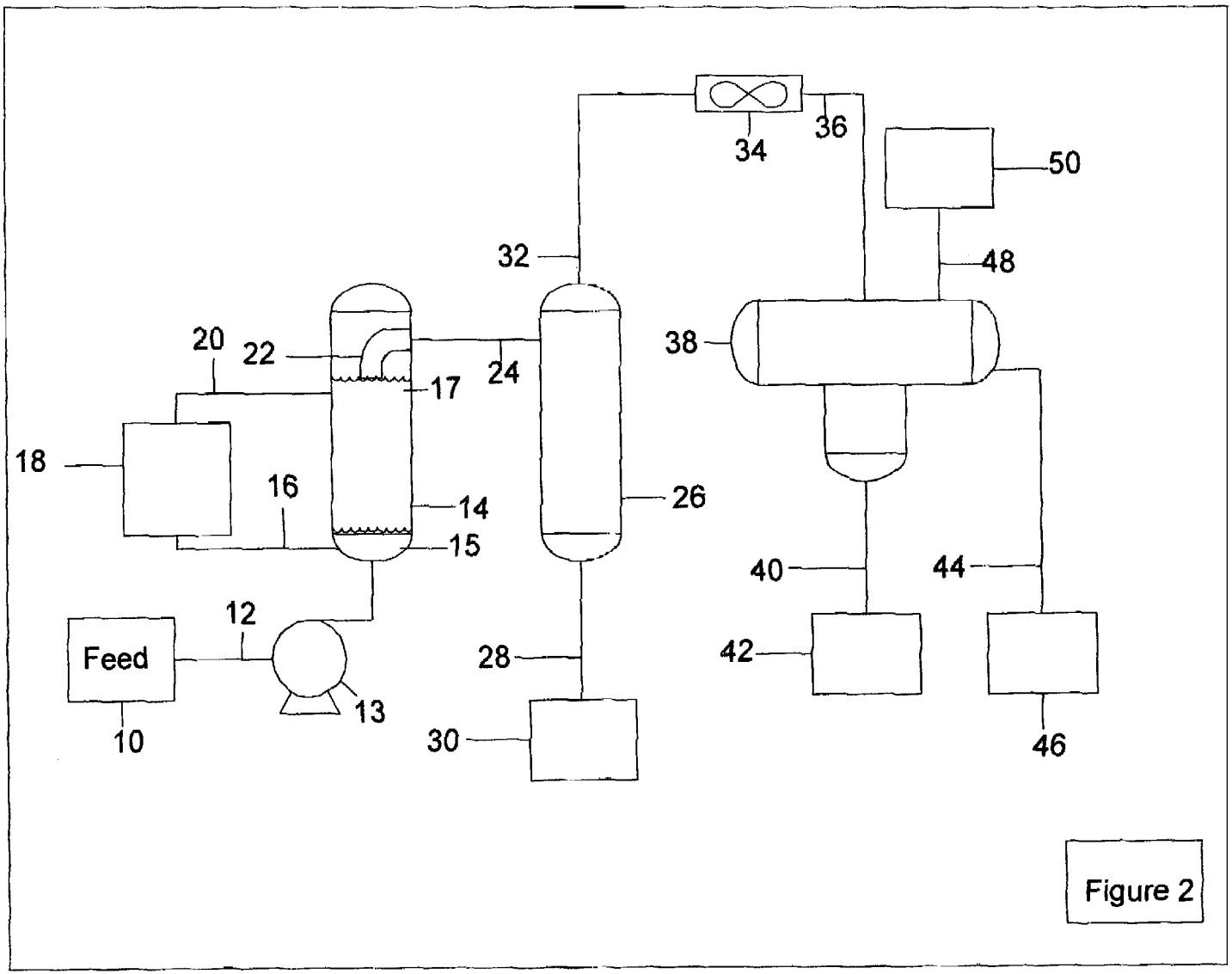
FIG. 2 is similar to FIG. 1, but differs in that ULO, rather than molten salt, is the continuous phase.

In FIG. 1, as-received Used Lube Oil (ULO) flows from a feed storage system, 10, through line 12 to the feed pump, 13, into the contactor vessel, 14, at or near its bottom. A heat transfer fluid, 15, that is immiscible with and much denser than ULO circulates from the bottom of the contactor vessel, 14, by line 16 to a heater, 18, that raises the temperature of the heat transfer fluid to the desired value. Heating may also be accomplished by operating electrical resistance elements in the heat transfer fluid phase in the contactor vessel, 14. The heat transfer fluid flows back to the contactor vessel by line 20. Flow of the heat transfer fluid through the heater, 15, may be by natural convection, as shown, or the fluid may be caused to flow through the heater, 18, by use of an appropriate pump. The total liquid level in the contactor, 14, is maintained by a vertical outlet pipe, 22, through which all gas, vapor and liquid leave the vessel and flow through line 22, to the separator vessel, 26. The inventory of heat transfer fluid sets its level in the contactor, 14. When the level of the heat transfer fluid, 15, is relatively high as shown in FIG. 1, ULO is the predominately dispersed phase and the heat transfer fluid is the predominately continuous phase. When the level of the heat transfer fluid is relatively low as shown in FIG. 2, ULO is the predominately continuous phase and the heat transfer fluid is the predominately dispersed phase.

The liquid and vapor entering the residue separator vessel, 26, separate into a liquid stream, 28, and a vapor stream 32. The liquid stream, 28, flows to a residue storage system 30. The vapor stream, 32, flows through a cooler, 34, that may use air as shown in FIGS. 1 and 2 as the cooling fluid or some other cooling media such as boiling water, cooling water or some other fluid. The outlet temperature of the cooler 34 should be low enough to condense substantially all of the oil in the feed, 10. Usually an outlet temperature of less than 150° F. (65.5° C.), causes nearly all of the feed to condense. The condensed stream flows by line 36 to an overhead separator vessel, 38, where any water in the feed, 10, separates and flows out through line 40 to a water storage system, 42. Liquid oil in stream 36 flows out through line 44 to an overhead oil storage system, 46. Any non-condensable gases flow out through line 48 to a gas handling system, 50. For extremely low flows of non-condensable gas and slightly above atmospheric pressure for the operating pressure of the overhead separator vessel 38, the gas handling system may be simply a vent. For larger flows, a flare, or some other appropriate gas treatment system may be required. The gas handling system may also incorporate a vacuum system to cause the contactor, 14, the residue separator, 26, and the overhead separator 38 to operate at sub-atmospheric pressure.

Figure 3:
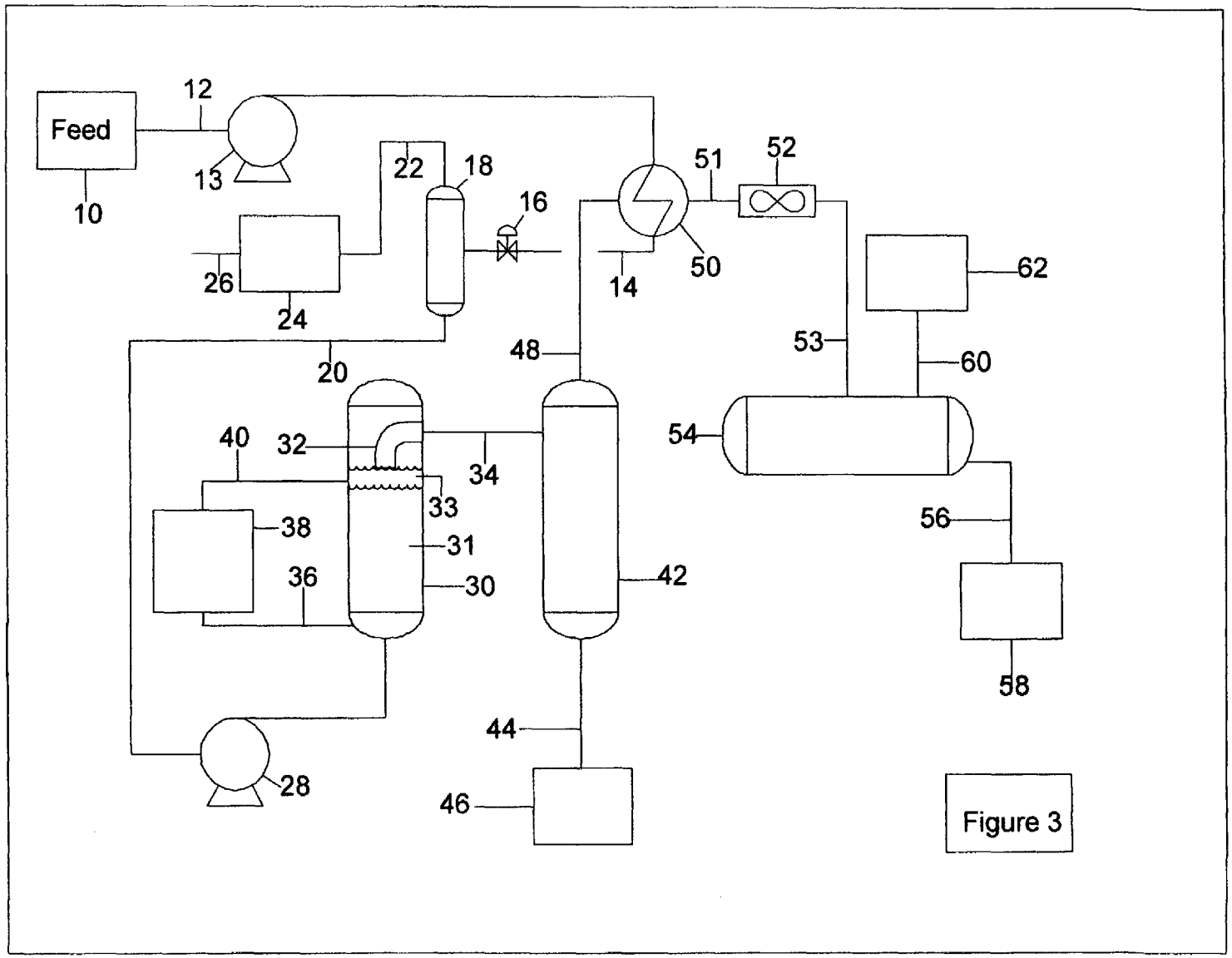
FIG. 3 shows an embodiment with a dehydration station upstream of the molten salt heating zone.

FIG. 3 shows a more preferred embodiment of the subject invention. Feed ULO, 10 flows by line 12 to a charge pump, 13 to a partial condenser, 50, that heats it by partially condensing vapor from the overhead separator vessel, 42, to a temperature of approximately 350° F. (176.7° C.). The heated feed flows through line 14 to a pressure-reducing valve, 16, and then to a flash vessel 18. All water and approximately 1% of the hydrocarbons contained in the feed, 10, vaporize and flow by line 22 to a thermal oxidizer, 24, or some other appropriate treatment system where the hydrocarbons are converted to carbon dioxide and water and vented through line 26.

The dried feed flows by line 20 to the feed pump, 28, where it enters the bottom of the contactor vessel, 30, where it is contacted with a heat transfer fluid phase, 31. The heat transfer phase may be the continuous or dispersed phase as described earlier. The vertical outlet pipe, 32, maintains the total liquid level in the contactor vessel, 14. All gas, vapor, and liquid exit the contactor through line 34 to the residue separator vessel, 42. Liquid residue flows through line 44 to a residue storage system 46. Vapor flows through line 48 to the partial condenser, 50, where it is partially condensed by heating the feed as described earlier. The partially condensed vapor flows through line 51 to a cooler, 52 where its temperature is reduced to at least 150° F. (65.5° C.) by heat exchange with a cooling fluid. The condensed stream flows through line 53 to the overhead separator, 54. Liquid overhead flows out by line 56 to an overhead storage system, 58. Any non-condensable gases flow by line 60 to a gas handling system. The gas handling system may include a vacuum system so that the contactor, 30, the residue separator, 42 and the overhead separator, 54 can operate at sub-atmospheric pressure.

DESCRIPTION OF PREFERRED EMBODIMENTS

Any salt can be used as part or all of the molten salt bath, so long as it is in a liquid phase at the desired operating temperature. Salts heretofore used for indirect heating, i.e., salts for constant temperature molten salt baths, may be used herein. Not all salts will give equal results and some present significant safety concerns, e.g., salts of lead or antimony are toxic, but they can be included as part of the molten salt bath, if desired. Any feed containing a normally liquid hydrocarbon can be heated using the process of the present invention. The normally liquid hydrocarbons include C5 and heavier hydrocarbons, e.g., naphtha boiling range up through residual fractions. Heavy feeds are contemplated for use herein, including those which are so heavy that they are not liquid at room temperature, e.g., a grease, wax, petrolatum or indeed any hydrocarbon having a high melting point may be used as feed. These materials will, upon heating, form liquids and may be used as feed. Treatment of solids is outside the scope of the present invention, i.e., treatment of coal or dirt contaminated with oil is outside the scope of the present invention. What is essential for the practice of the present invention is direct contact heat exchange of a liquid by a liquid. The liquid must contain hydrocarbons and can even be a pure hydrocarbon. The liquid feed usually will be contaminated with undesired lighter or heavier components which can be removed by heating, either to vaporize a desired feed component from a residue fraction or to remove an undesired lighter contaminant from a desired residue product fraction.

When processing ULO, the ULO will frequently contain both light and heavy contaminants. Light contaminants include water, naphtha and some impurities introduced during the ULO collection process. Heavy contaminants include the additive package. When processing ULO, the economic incentive is to vaporize as much of the feed as possible. This can create a problem as the residue will not flow when more than 83 to 85% of the feed is vaporized. I believe that a practical limit is 80% vaporization of the dry oil.

A surprising feature of the use of molten salt to heat ULO and vaporize the lube oil boiling range components therefrom, is that it is easy to achieve deep de-oiling of the ULO. The salt temperature at the bottom of a molten salt continuous bath and the oil temperature at the top of the contactor, the oil floating on the surface of the molten salt, are very close. I have never seen more than 5° F. difference in them. There is evidence that no fouling has yet occurred.

The invention contemplates the use of a range of molten salts for the high-intensity drying and/or heating process. These include low-melting point salts. When simple drying or only a modest amount of thermal processing is desired, the candidate molten fluids may have melting points typically ranging from 60.–230.degree. C.

It is essential that the molten salt be immiscible with the ULO and substantially denser.

It is preferred that the interfacial surface tension between the molten salt and the liquid feed be sufficiently high to avoid sticking of the molten fluid to the wet surface. The thermal conductivity of the molten fluid should also be sufficiently high to ensure that the molten fluid remains in a liquid state, at least during the process, so that fluid does not solidify to form a solid film or freeze cone at the point of contact with the ULO.

When the thermal conductivity of the fluid is sufficiently high, the fluid conducts heat from the body of the molten bath to the interface contact region between drops or streams of ULO and molten heating medium, or drops or streams of molten heating medium when the ULO is the continuous phase. The high density of molten salt relative to ULO promotes rapid transit of one fluid through the other and plenty of motive force should baffles or column packing be used.

A spectrum of molten salt temperatures can be used, from high to low.

ILLUSTRATIVE EMBODIMENTS

The following details are provided to show a good way to practice the present invention, but they do not represent actual experiments.

For tests, I would use a length of 4" schedule 40 stainless steel pipe. The salt used would be molten and have a low vapor pressure at temperatures from 600 to 1000 F. The depth of molten salt would be about 20", with about 12" of freeboard or vapor space above the molten salt. The stainless steel pipe will be heated by a cylindrical heater, an electric jacket with a thermostat. The ULO feed will be added into the bottom of the molten salt bath via a ¼" nipple with a length of ⅛" SS tubing affixed so that the tubing did not extend into the molten salt bath. The process should be run under vacuum, which is customary for lube oil recovery processes, preferably at about 0.5–1 psia.

It may be necessary to first dehydrate the ULO, or to conduct the process in at least two stages, with the first stage dehydrating the oil.

It may be necessary to add heat tape to the stainless steel tubing to prevent a freeze cone or freeze debris from forming near the point of feed injection. This will probably not be a problem in commercial sized units, but if it is some form of heating of the feed injection means can be used to overcome it.

ULO re-refiners may operate at low temperatures, from 50 to 150 C, using a molten salt bath merely to remove water and/or "light ends" which may be present. This mild use of the technology would permit a fleet operator to periodically condition the motor oil used in vehicles, by removing water and crankcase dilution, and return the conditioned motor oil to the vehicle, perhaps with some additional additives. Some re-refiners, especially those with no market for a heavy liquid residue product, may want to use higher temperatures, say 300 to 400 C or even higher, to maximize production of distillable hydrocarbons and minimize production of "ash" or sludge from the ULO, to simultaneously improve product recovery and minimize disposal costs.

In the process of the invention, especially when practiced with a salt bath continuous phase, ULO, when injected into the base of the bath, is almost instantly heated, causing some vaporization and disruption of any large droplets of ULO that may try to form. The ULO vapors produced are much lighter than the residual ULO liquid, and are believed to form something like a three phase bubble, with a vapor top, liquid oil bottom in a molten salt shell. If a large bubble forms, the light vapor portion will either break away from the residual ULO liquid, or at the least cause some form of vigorous agitation as the large three phase bubble rises. If the vapor portion breaks away, that leaves the residual ULO liquid to form a new bubble, but of liquid, or at least much more liquid than before the vapor phase broke away, and this denser bubble will not rise as quickly in the molten salt bath, giving more time for the molten salt to heat the ULO.

Radiant heat transfer is also believed to play a significant part, in that the lens shaped oil pool in the lower portion of a bubble has a large surface area to volume ratio, one or more orders of magnitude more favorable for heat transfer than can occur when the ULO is passed through a salt tube of 4"–6" or similar diameter, in a fired heater. Radiation heat transfer is considered to play a negligible part of transferring heat from a hot salt heat exchange surface to oil flowing within, or around, the surface. In my process, the bubbles are small enough and can "see" enough hot molten salt so that a significant amount of radiant heat transfer occurs.

Based on my work done to date the optimum conditions for temperature and pressure will be around 600 to 620° F. and 1 to 1.5 psia. There are actually an infinite number of temperature pressure combinations that will give the 80% overhead yield desired. For ULO, the limits on the combinations of pressure and temperature may range from 580° F. at 0.01 psia to 800° F. at near atmospheric pressure. Either of these extremes could result in an inoperable situation. The key parameter is vaporizing 75 to 80% of the feed without causing problems that make the process inoperable.

The ultimate use of the products, both the overhead lube oil fraction and the residue fraction, can have an important influence on operating conditions. When the process is being practiced to recover a high quality lubricating oil base stock, or a material which can be subjected to further conventional processing to make it a base stock, relatively low temperatures and somewhat lower product recoveries may be optimum. When the residue product is going to be an asphalt extender, the desire to preserve as much as possible of the plastic present in the ULO, primarily the viscosity modifier, to improve asphalt properties. When the overhead product will be FCC feed, a much lower quality product can be tolerated, so higher temperatures and higher recovery may be optimum. To minimize production of low value waste, and this will usually be the residual fraction of the ULO, after the lubricant boiling range hydrocarbons have been removed, it may be important to have very high temperatures and/or lower pressures, to reduce the resid fraction as much as possible.

Reducing Conditions

It is believed to be important to maintain reducing conditions during processing. Salt baths can be reactive, especially when used in an oxidizing atmosphere, for destruction of waste streams. Oxidizing atmospheres, if present during lube oil recovery, will degrade the quality of the lubricating boiling range hydrocarbons recovered overhead, so use of a reducing atmosphere is preferred.

When a molten salt bath is used for simple dehydration of ULO, or to remove light ends, such as naphtha or other materials sometimes present as "crankcase dilution" it is not so critical to maintain a reducing atmosphere, as the temperatures involved are usually so low that oxidation reactions will either not occur or occur so slowly as not to be troublesome.

General Considerations

It is important to use a molten fluid, with a "heat range" within that required for the desired process objectives. When simple dehydration of ULO is all that is required, and this will usually be a first or preliminary treatment rather than the entire process, molten salt which is molten in the 80 C+ temperature range is suitable. When distillation of lubricating oil boiling range components from the ULO is desired, the salt must remain molten at temperatures above 100 C to say 600 C. When some carbonization or "coking" of a residue fraction is desired, even higher temperatures may be required, typically 200 C to 700 C.

The upper limit on temperature/choice of the salt alloy is determined by volatility and process constraints. The preferred molten salts will have a low vapor pressure at the temperatures used, so that loss of molten salt due to "dusting" or for any other reason is less than 1% a day. The salts chosen should not be corrosive under process conditions and preferably are non-toxic, for safety.

This invention permits drying and/or recovering lube oil base stocks and/or other hydrocarbons from used motor oil. The process and apparatus of the present invention also permits efficient processing of other waste or low value oil streams that contain so much emulsified water and/or additives that conventional processing is impractical.

When used to process ULO, this invention permits the separation of additive packages from valuable distillable hydrocarbons in the waste motor oil with limited, or no, decomposition of these distillable hydrocarbons. When the residual fraction from the ULO is destined for use as an asphalt extender, it may be beneficial to have some or most or even all of the additive package intact. The plastic viscosity modifiers used in some lube oils may have beneficial effects on the asphalt, so it is good to have a process which gives re-refiners the option to decompose, or not decompose, the additive package.

The process and apparatus of the present invention may also be used to heat other thermally unstable, or difficult to heat, liquids.

Re-refiners may wish to operate under a hard vacuum, to maximize recovery of lube oil components and minimize decomposition of additives. Others may wish to operate above 1 atm up to 100 atm pressure, or more, to minimize vapor volumes and facilitate processing of streams with large amounts of water. Higher pressures permit a more compact facility to be built.

Multiple molten salt baths may be used, much as product fractionators use multiple distillation trays, each operating at a slightly different temperature.

I claim:

1. A method of refining used lubricating oil (ULO) containing lubricant boiling range hydrocarbons and thermally decomposable additives to recover as a hydrocarbon liquid product at least a portion of said lubricant boiling range hydrocarbons comprising:

a. heating said ULO by direct contact heat exchange with molten salt having a temperature of 100° to 600° C. for a time sufficient to vaporize at least a portion of said lubricant boiling range hydrocarbons;

b. removing as a vapor product said lubricant boiling range hydrocarbons; and c. recovering from contact with said molten salt a liquid residue product comprising said thermally decomposable additives or decomposition products thereof as a heavy liquid product.

2. The process of claim 1 wherein said ULO contains distillable, lubricant boiling range hydrocarbons and non-distillable or thermally decomposable additives and said ULO is heated by direct contact heat exchange to a temperature of 100° to 400° C. and sufficient to vaporize at least a majority of said lubricant boiling range hydrocarbons and recovering said vaporized lubricant boiling range hydrocarbons as a product of the process.

3. The process of claim 2 wherein said temperature and residence time are sufficient to decompose at least a majority of said decomposable additives and vaporize at least a majority of said lubricant boiling range hydrocarbons.

4. The process of claim 1 wherein at least a majority of said ULO is recovered as a vapor fraction which is essentially free of motor oil additives and at least a majority of said additives, or decomposition products thereof, are recovered as a separate liquid phase from said molten salt.

5. The method of claim 1 wherein said molten salt is maintained as a continuous phase.

6. The method of claim 5 wherein said molten salt is disposed as one or more baths of molten salt and said ULO is injected into, or bubbles up through, said molten salt.

7. The method of claim 1 wherein said ULO is maintained as a continuous phase and said molten salt is poured, sprayed or otherwise passed down through said continuous ULO phase.

8. The method of claim 1 wherein 75 to 80 LV % of the feed is vaporized.

9. The process of claim 1 wherein direct contact heat exchange occurs under vacuum.

10. A process for refining a used lubricating oil (ULO) liquid feed comprising water, lubricant boiling range hydrocarbons and non-distillable or thermally decomposable additives comprising:

a. dehydrating said ULO in a dehydration stage by heating at a temperature and pressure sufficient to vaporize said water from said ULO and produce dehydrated ULO;

b. heating said dehydrated ULO by direct contact heat exchange with molten salt at a temperature and pressure sufficient to vaporize at least a majority of said lubricant boiling range hydrocarbons in said dehydrated ULO aid produce a vaporized lubricant boiling range hydrocarbon fraction and a residue liquid phase containing at least a majority of said non-distillable or thermally decomposable additives or decomposition products thereof;

c. cooling and condensing said vaporized lubricant boiling range hydrocarbons to produce a liquid product stream containing at least a majority of the lubricant boiling range hydrocarbons present in said ULO feed; and d. removing said residue liquid from contact with said molten salt as a product of the process.

11. The process of claim 10 wherein said molten salt is maintained as a continuous phase.

12. The process of claim 10 wherein said molten salt has a temperature of 100° to 600° C.

13. The process of claim 10 wherein direct contact heat exchange occurs at a pressure of 0.01 to 1.5 psia.

14. A process for distilling a used lubricating oil (ULO) liquid feed comprising lubricant boiling range hydrocarbons and a non-distillable residue fraction to produce two liquid product streams comprising:

a. beating said ULO liquid feed by injecting said feed into a molten salt bath operating at a temperature of 580 to 800° F. and pressure of 0.01 to 1.5 psia, wherein said temperature and pressure are sufficient to vaporize at least a majority of said lubricant boiling range hydrocarbons present in said liquid ULO feed but vaporizing no more than 85 LV % of said ULO liquid feed and produce a vapor fraction comprising at least a majority of the lubricant boiling range hydrocarbons within said ULO liquid feed and a liquid phase residue comprising said non-distillable residue fraction;

b. removing from contact with said molten salt bath said vapor fraction as an overhead vapor stream;

c. cooling and condensing said overhead vapor steam to produce a first liquid phase product comprising at least a majority of said lubricant boiling range hydrocarbons in said ULO feed; and d. removing from contact with said molten salt bath said liquid phase residue as a second liquid phase product.

15. A process for heating and partially vaporizing a thermally unstable liquid feedstock which cokes and/or rapidly fouls metal surfaces such as tubes in a fired heater, heat exchanger tubes, or the like, comprising:

a. injecting liquid droplets of said thermally unstable feed into a non-pyrolyzing molten salt bath operating at a temperature of 100 to 500° C. and a pressure;

b. heating said injected droplets by direct contact heat exchange with said molten salt bath to a temperature, at the pressure in said bath, sufficient to vaporize at least a portion of said feed in each droplets and form bubbles rising up through said molten salt bath, each bubble having a vapor phase top and a residual liquid feed bottom in a molten salt shell;

c. heating said liquid in said bubble by direct contact heat exchange with said molten salt and heating said liquid by radiant heat transfer with said molten salt bath, to produce rising heated bubbles comprising heated liquid feedstock and vapor produced by heating said liquid feedstock to produce rising bubbles comprising a heated liquid phase and a vapor phase;

d. removing from above said molten salt bath said vapor phase as an overhead vapor product; and e. removing from above said molten salt bath said heated liquid phase as a liquid phase product.

* * * * *